US008789301B2

(12) United States Patent
O'Neill

(10) Patent No.: US 8,789,301 B2
(45) Date of Patent: Jul. 29, 2014

(54) ACHIEVEMENT AWARD ASSEMBLY

(76) Inventor: James J. O'Neill, Palatine, IL (US)

( * ) Notice: Subject to any disclaimer, the term of this patent is extended or adjusted under 35 U.S.C. 154(b) by 0 days.

(21) Appl. No.: 13/475,012

(22) Filed: May 18, 2012

(65) Prior Publication Data

US 2012/0291322 A1 Nov. 22, 2012

Related U.S. Application Data

(60) Provisional application No. 61/487,571, filed on May 18, 2011.

(51) Int. Cl.

| | |
|---|---|
| ***A47G 1/06*** | (2006.01) |
| ***G09F 1/00*** | (2006.01) |
| ***G09F 7/00*** | (2006.01) |
| ***G09F 19/00*** | (2006.01) |

(52) U.S. Cl.

USPC ..... 40/735; 40/124.191; 40/768; 40/769; 40/124.02; 40/611.01; 40/611.03; 40/615

(58) Field of Classification Search

USPC ..... 40/735, 124.191, 769, 768, 124.02, 40/611.01, 611.03, 615

See application file for complete search history.

(56) References Cited

U.S. PATENT DOCUMENTS

| | | | | |
|---|---|---|---|---|
| 4,553,344 | A * | 11/1985 | Rubin et al. | 40/735 |
| 5,415,902 | A | 5/1995 | Stryker, Jr. | |
| 6,119,386 | A * | 9/2000 | Henry et al. | 40/769 |
| 6,131,322 | A * | 10/2000 | Hjaltason | 40/615 |
| 6,434,873 | B1 | 8/2002 | Pierce | |
| 6,578,305 | B2 * | 6/2003 | Lebrun | 40/800 |
| 7,325,339 | B2 | 2/2008 | Jordan | |
| 2004/0045201 | A1 * | 3/2004 | Kalb et al. | 40/611.01 |

* cited by examiner

*Primary Examiner* — Syed A Islam
(74) *Attorney, Agent, or Firm* — Vedder Price PC

(57) ABSTRACT

An achievement award assembly includes a first panel having a semi-transparent area, a second panel having an award indicia that is visible through the semi-transparent area and a mount. The semi-transparent area may be configured such that the award indicia, when viewed through the semi-transparent area, appears as an engraved metallic plate.

17 Claims, 7 Drawing Sheets

ACHIEVEMENT AWARD ASSEMBLY

RELATED APPLICATIONS

This application claims priority to and the benefit of U.S. Provisional Patent Application 61/487,571, entitled "Achievement Award Assembly," which was filed on May 18, 2011.

FIELD OF THE DISCLOSURE

The present disclosure relates to assemblies for achievement awards and methods for constructing such assemblies.

BACKGROUND

Achievement awards are prevalent in every sector of society, from kids to adults. In particular, plaques are often utilized to recognize participation on a team, winning a contest, or other similar achievements. For example only, traditional employee of the month plaques usually have a plurality of metal plates with the honored employee's name engraved thereon. The disadvantage of this design is that a separate plate must be engraved each month, which is usually a strong enough disincentive that the program flounders after a few months. Another example might be an award with text that would be for a single occasion or event, such as an award at a golf outing. The disadvantage of traditional plaque-type awards is that the honoree or winner is not known until the end, shortly before the award is presented.

Therefore, there is a need in the art for an achievement award assembly that is easy to create, easy to update or change, eco-friendly (in the sense that the award could be reused), allows instant recognition, allows for several different patterns for signage or awards and does not require significant technical knowledge.

BRIEF DESCRIPTION OF THE DRAWINGS

The disclosure will be more readily understood in view of the following description when accompanied by the below figures and wherein like reference numerals represent like elements, wherein.

DETAILED DESCRIPTION

Figure 1:
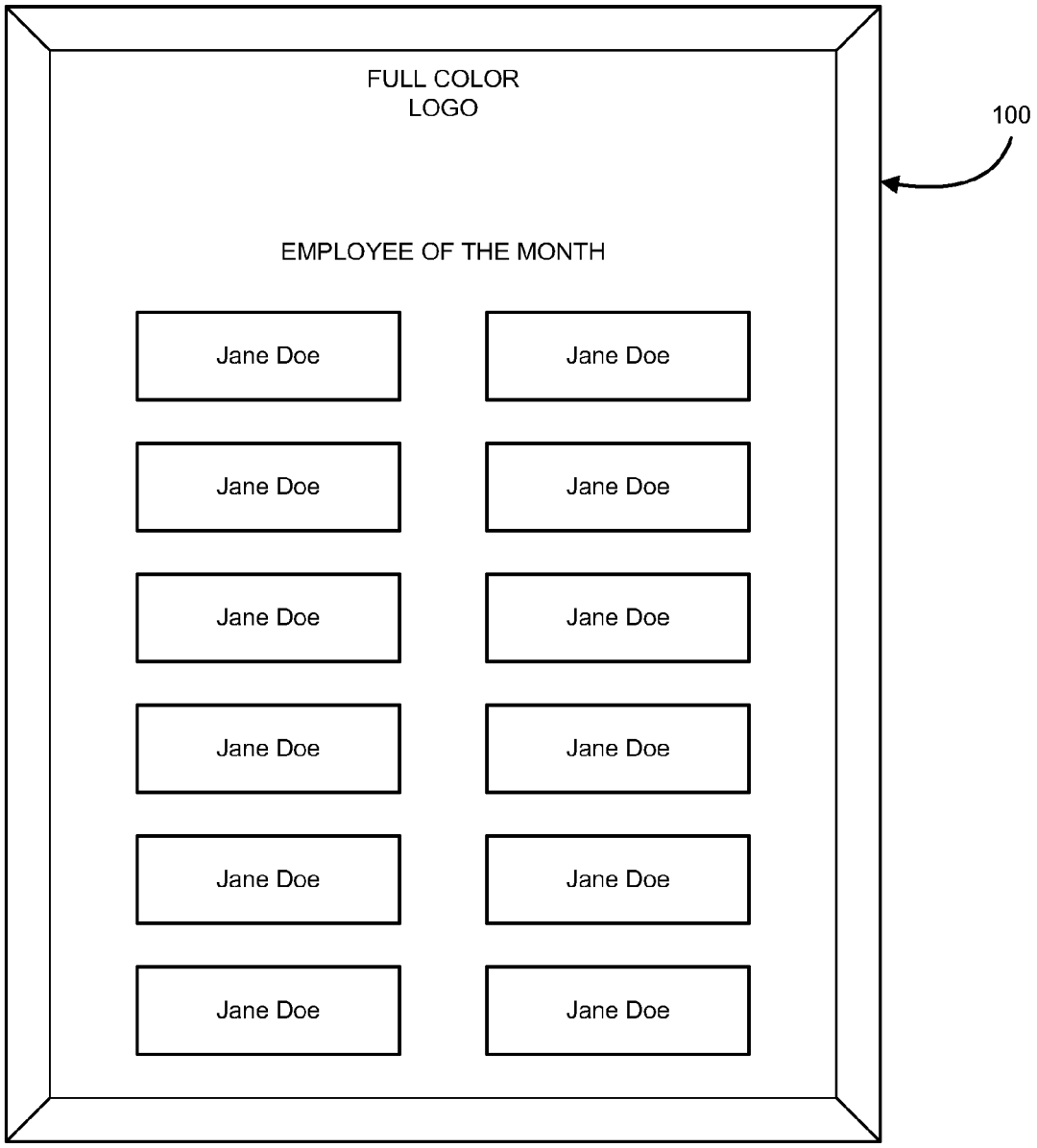
FIG. 1 is front plan view of an embodiment of an achievement award assembly in accordance with the present disclosure.

The present disclosure provides methods and assemblies for achievement awards. The following description of the embodiments is merely exemplary in nature and is in no way intended to limit the disclosure, its application, or uses. FIG. 1 illustrates a front plan view of an achievement award assembly 100 in accordance with one embodiment of the present disclosure. This embodiment would be sold through several sales channels to companies across the country as a "Do-It-Yourself Employee of the Month" plaque. The achievement award assembly structure is as described below with respect to the individual components and methods of assembly. In use, the manager responsible for adding the next months employee name to the plaque may use a computer software template to enter the name, month and department of the honored employee. Then, the template document is printed out in black ink on any laser or inkjet printer. The manager may then insert and align the template document into the easel door, aligning the printed text into the simulated plate—semi-transparent rectangles on the plaque. From the front the viewer would see the text on a seemingly solid brushed gold plate. This would simulate black engraving on a gold plate. The manager may then place the plaque in a public area and repeat the print and insertion on a monthly basis, instead of ordering a plate, waiting for it to come, applying it, etc. The advantages of this embodiment of the achievement award is evidenced by the numerous existing employee of the month plaques with no names or being behind six months old (i.e., disadvantages of prior designs, where the process is too cumbersome). Obviously, it is within the teachings of the present disclosure that other applications for signage and other awards are equally applicable. Another example might be a wall sign for an occupant that changes often. The manager could open the wall sign constructed in accordance with this disclosure that has an opening that appears to be a cast bronze plate. After the insertion of a piece of paper with the new occupant name, it would appear that the name was cast into bronze.

Figure 2:
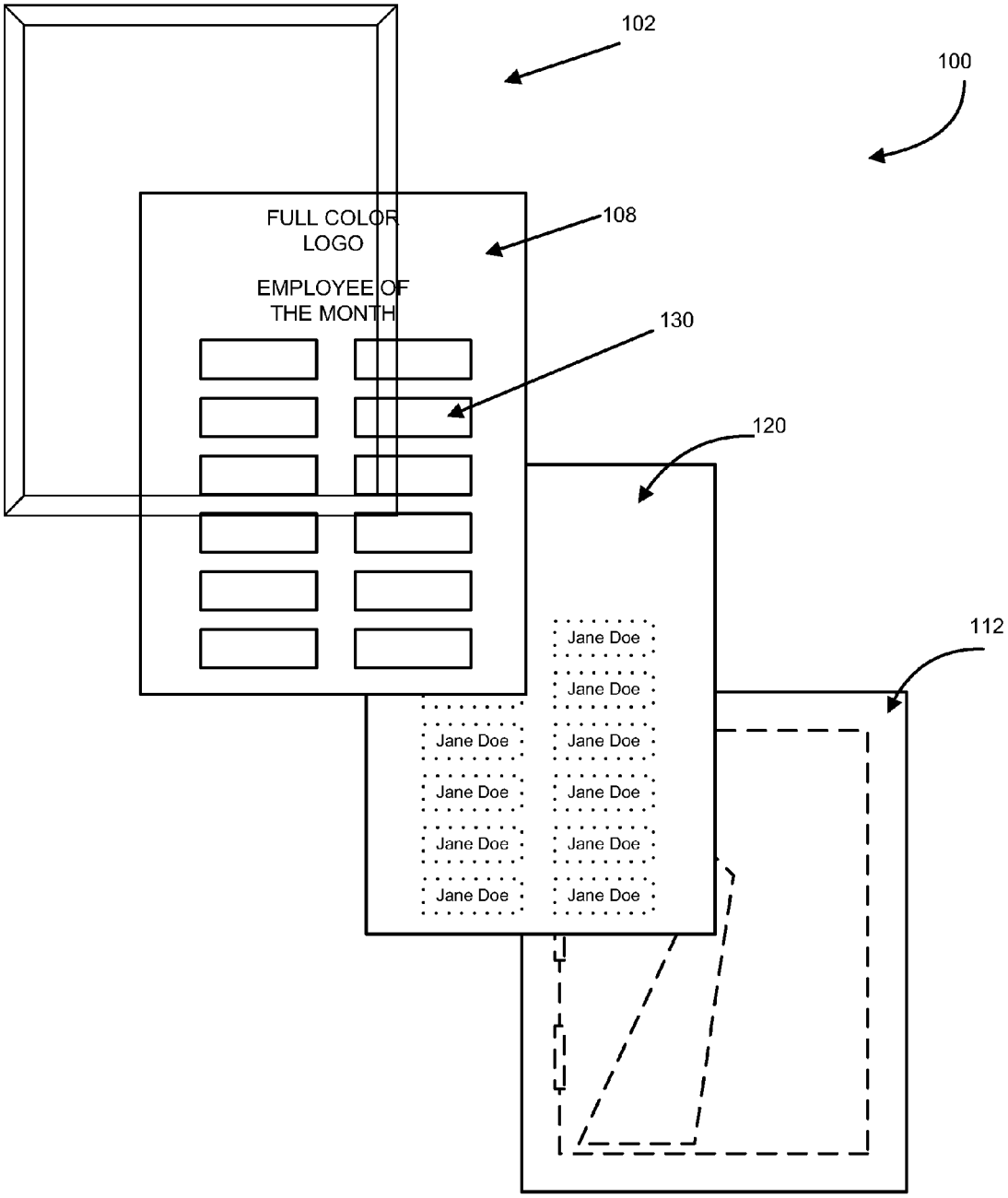
FIG. 2 is a sequential view of an embodiment of an achievement award assembly.
Figure 3:
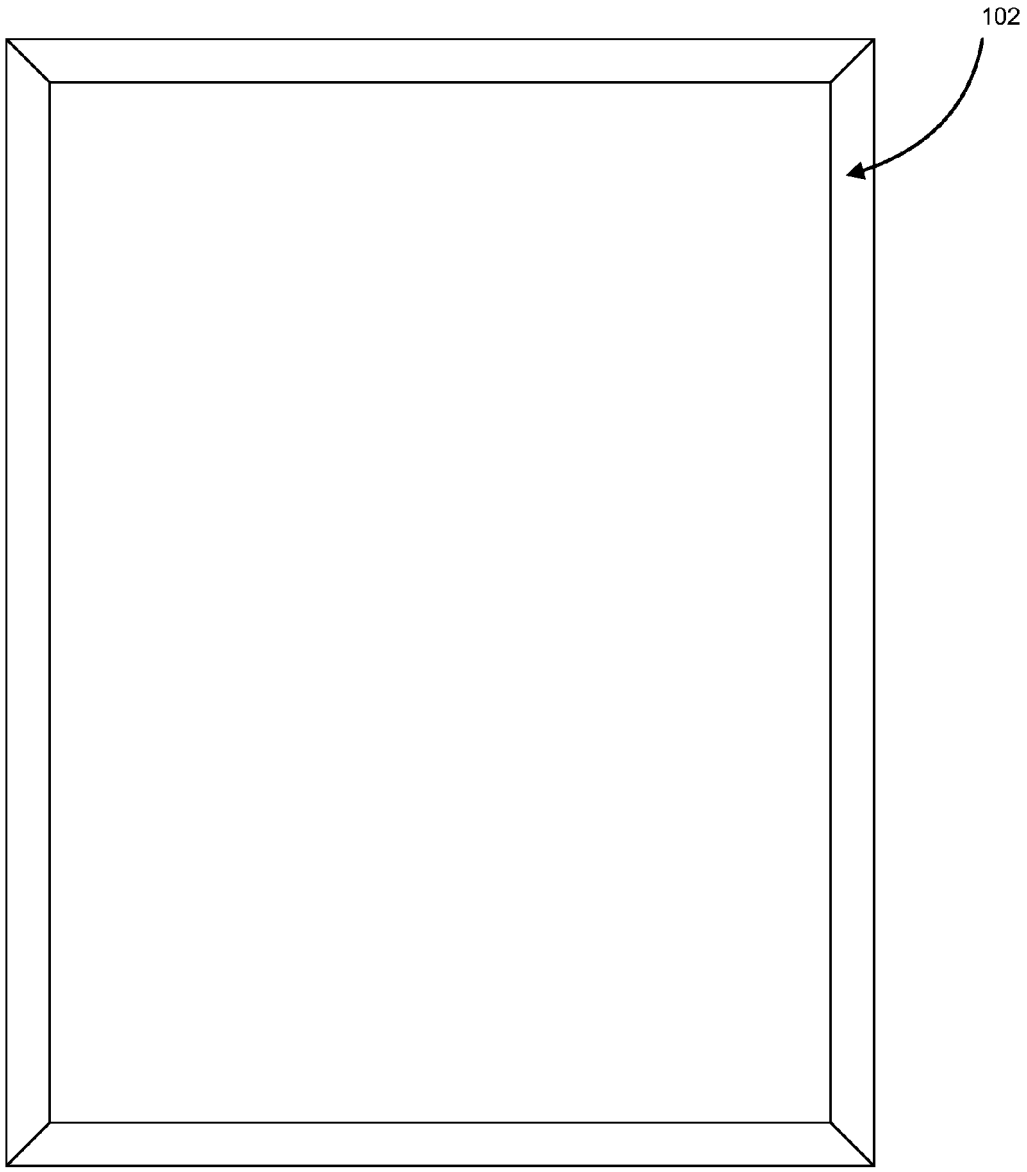
FIG. 3 is a front plan view of an embodiment of a first panel of an achievement award assembly.
Figure 4:
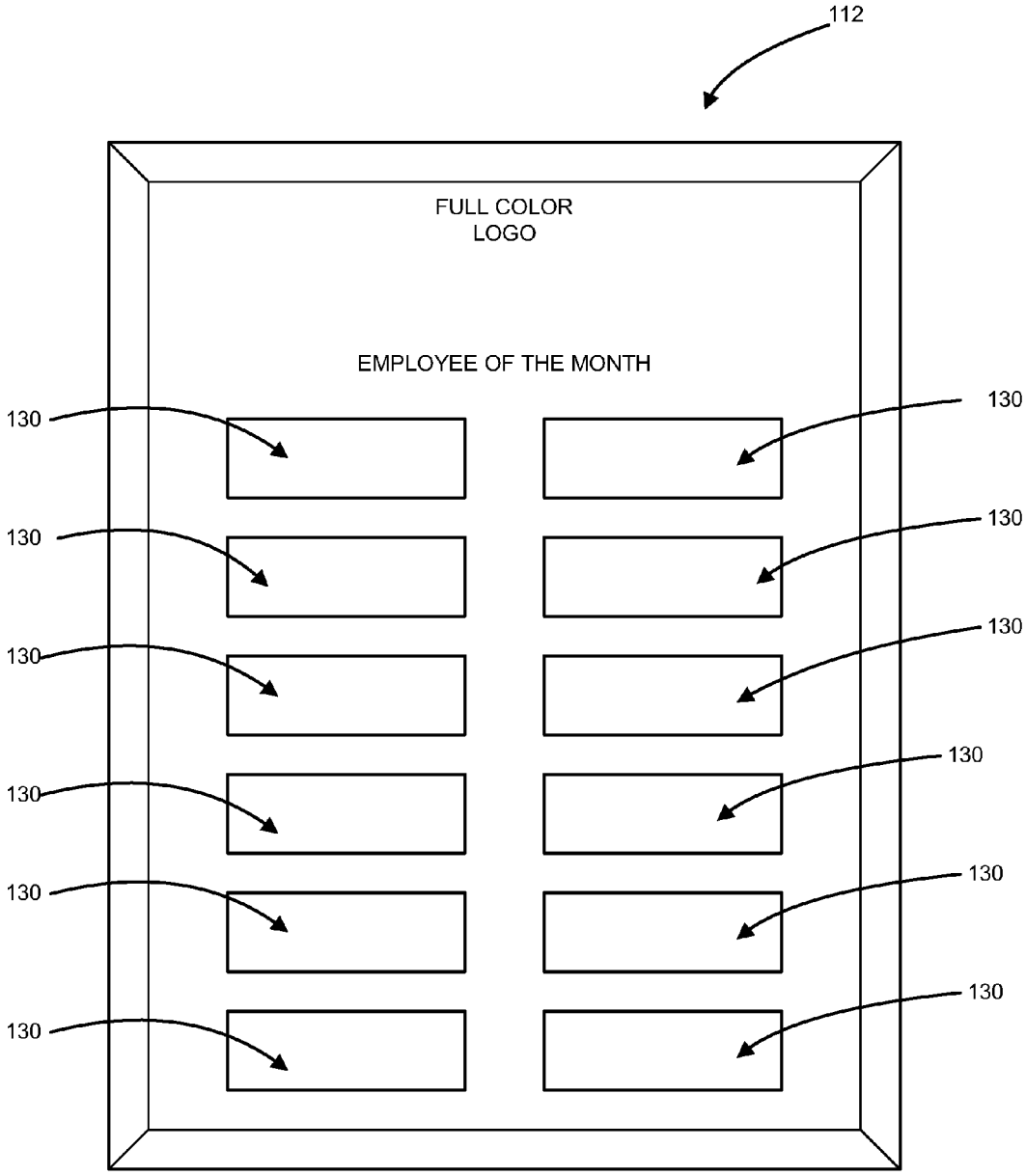
FIG. 4 is a front plan view of an embodiment of a first panel of an achievement award assembly including a first indicia layer printed on a rear side.

FIG. 2 is a sequential view of the achievement award assembly illustrated in FIG. 1 and can be used to illustrate the methods for constructing the achievement award assembly illustrated in FIG. 1. FIG. 3 is a front plan view of a first panel 102 of the achievement award assembly 100 illustrated in FIGS. 1 and 2. The first panel 102 may be configured as a clear material; preferably, in one embodiment, a 10.5"×13"×0.375" clear front beveled acrylic, such as Lucite™, plaque. A first layer 108 of semi-transparent indicia, such as a pattern that will appear like a solid material, such as brushed gold metal, slate stone or a golf ball, may be imprinted on a back or front side of the first panel. FIG. 4 is a front plan view of the first panel 102 of the achievement award assembly 100 illustrated in FIG. 2 including a first indicia layer 108 imprinted thereon (in one preferred embodiment, on the rear or back side of the first panel). An important aspect of the process is that the imprint can be used as the first indicia layer for an imprint of a name or other personalization printed on paper. For example, in the "Employee of the Month Plaque" the back side of the first panel may be imprinted with cyan, magenta, yellow and black ink in the image of the plaque, including the logo and award name, any artwork showing a colorful background, the company logo or the words Employee of the Month, for example. There may also be twelve defined areas 130 (representing the 12 months of a calendar year or other number of areas as per the period of measurement or frequency of the award) that may be configured for a display of indicia, such as in one embodiment an area defined by sides dimensioned at 2.5" and ends dimensioned at 0.75". These areas 130 may be imprinted with a suitable color as desired, such as a brushed gold simulated plate in one embodiment, in order to appear as brass plates similar to a conventional achievement award plaque. Preferably, all imprinting may be made in one pass from a color printer.

Figure 5:
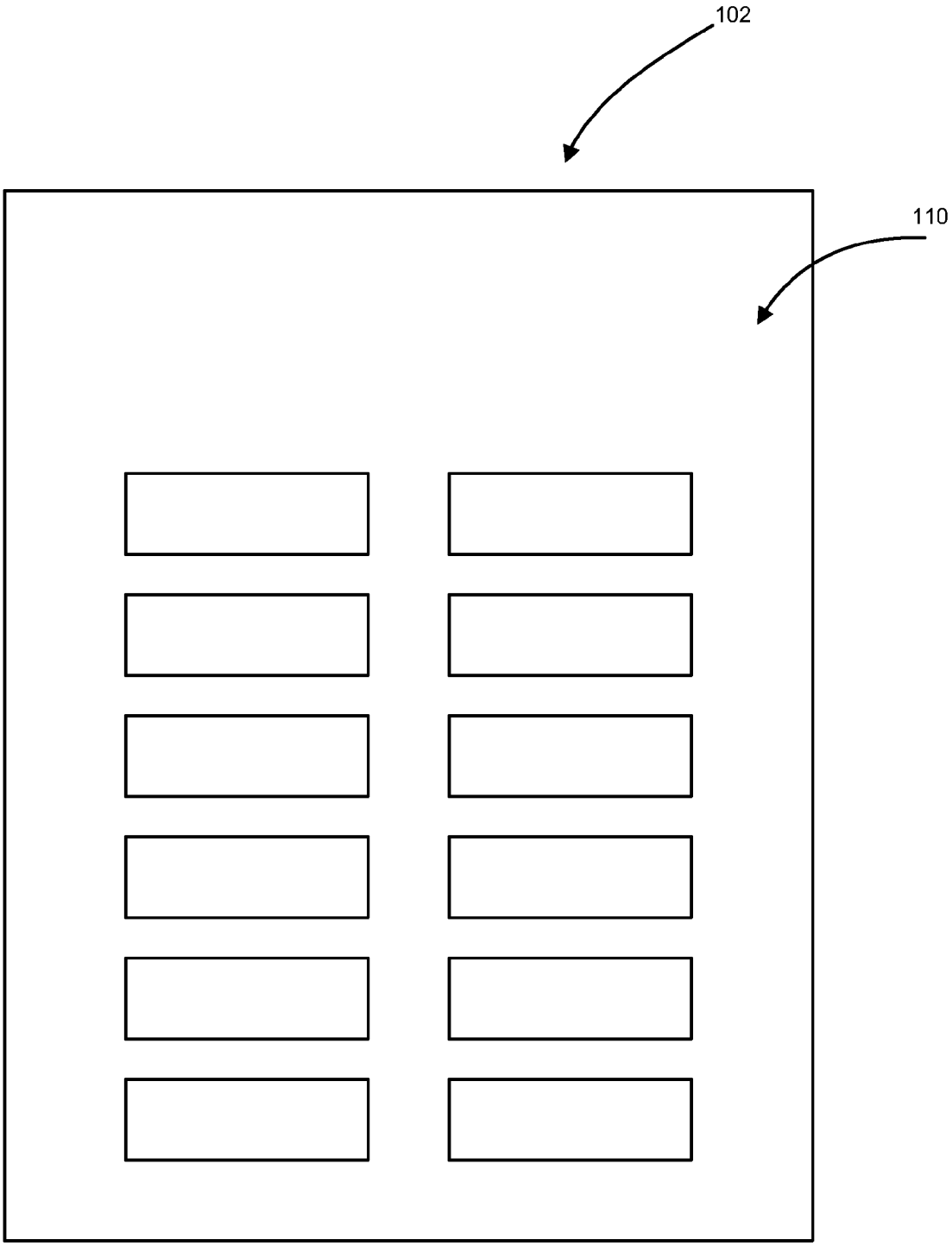
FIG. 5 is a rear plan view of an embodiment of a first panel of an achievement award assembly including a second indicia layer printed on the rear side.

Next, the color printer would then print a second indicia layer 110 on the same side of the first panel 102 (preferably the back or rear side). In one embodiment, the second indicia layer 110 is wholly comprise of white ink FIG. 5 is a rear plan view of the first panel 102 of the achievement award assembly 100 illustrated in FIG. 2 including a second indicia layer 110 printed on the rear side. Preferably, the white ink may complete an opaque background for the plaque, logo and text, but the defined areas 130 where the simulated plates were printed would not be printed with the second indicia layer 110 or white background, leaving them semi-transparent.

Figure 6:
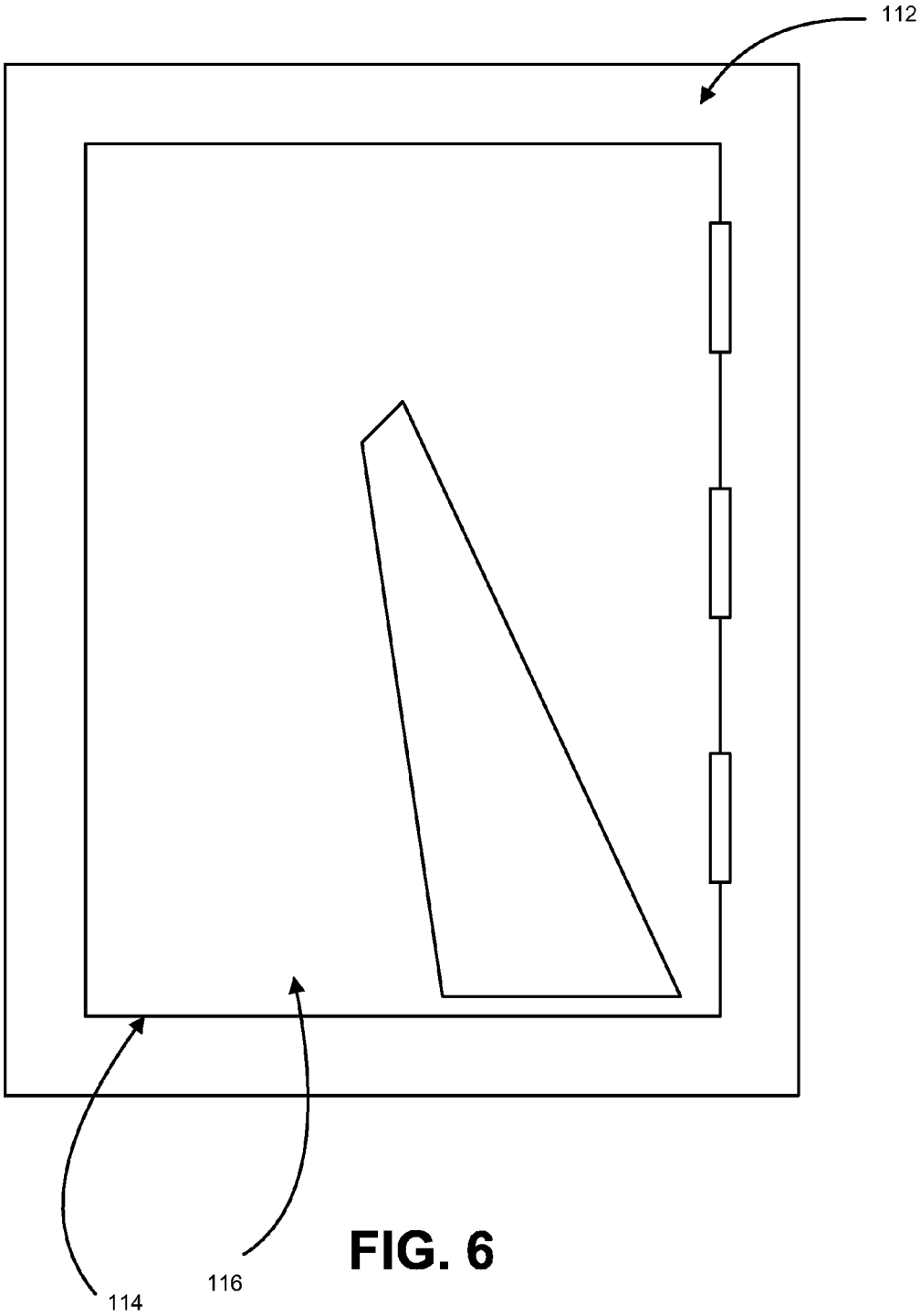
FIG. 6 is rear plan view of an embodiment of a mount of an achievement award assembly.

FIG. 6 is rear plan view of a mount 112 of the achievement award assembly 100 illustrated in FIG. 2. The mount 112 may be configured as a conventional easel as recognized by one of ordinary skill in the art. Additionally, the mount 112 may include a through opening 114 that is covered by a door 116 on the back side of the mount 112. For example, in one embodiment the easel may be a 9.5" or 10.25"×12.5" black chipboard with a leatherette paper lamination (0.0625" thick) with a door for an 8.5"×11" document would then be attached. In one embodiment, the back or rear side of the first panel 102 is connected to the mount 112, for example by double sided tape, to cover the opening on a side of the mount 112 opposite from the door 116 such that the second indicia layer 110 is contiguous with the mount 112. The door 116 of the mount 112 may be configured in any suitable manner, such as secured to the mount 112 along a long side to provide a dimension of 8.5"×11" that opens and closes with a clasp.

Figure 7:
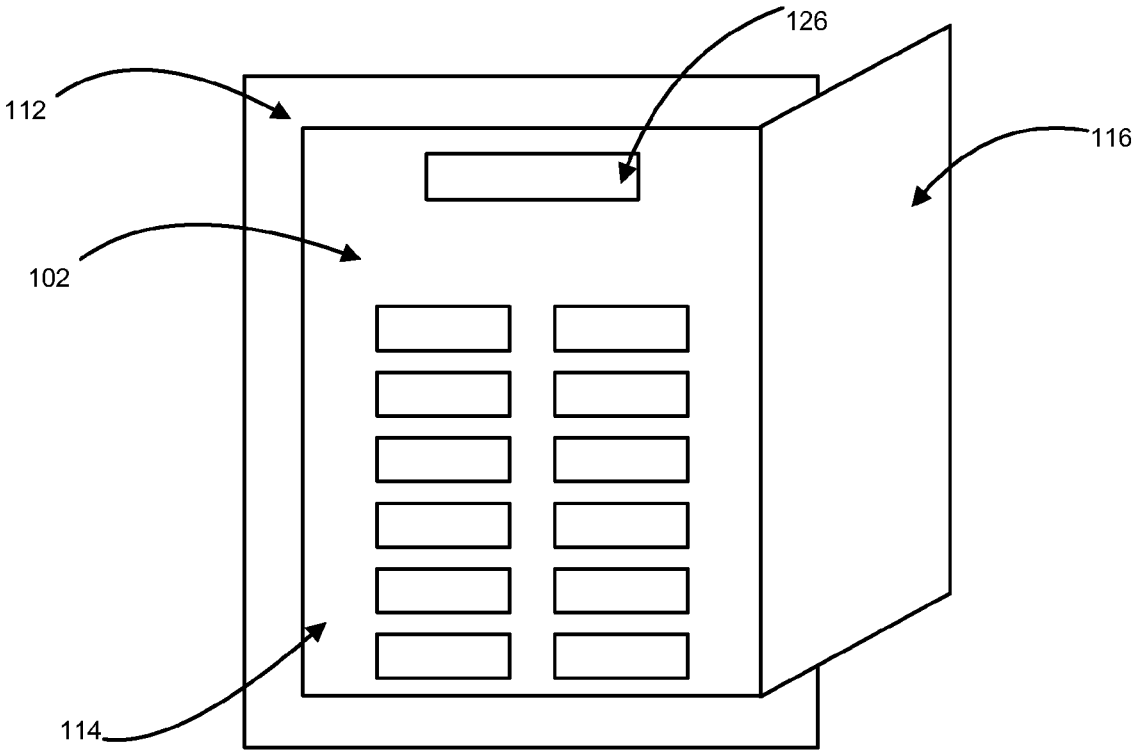
FIG. 7 is a rear plan view of an embodiment of an achievement award assembly with a second panel removed and with the door of the mount in an open state.

FIG. 7 is a rear plan view of the mount 112 of FIG. 6 including an opening 114 illustrating the first panel connected to the mount. In this embodiment, the door 116 has been moved from the closed position shown in FIG. 6 to an open position to expose the opening 114 and provide access to the back side of the first panel 102. Preferably, a portion 126 defined on the back side of the first panel on the second layer of indicia or on a portion of the mount adjacent the top of the opening is provided to secure the second panel 120 as described below.

Figure 8:
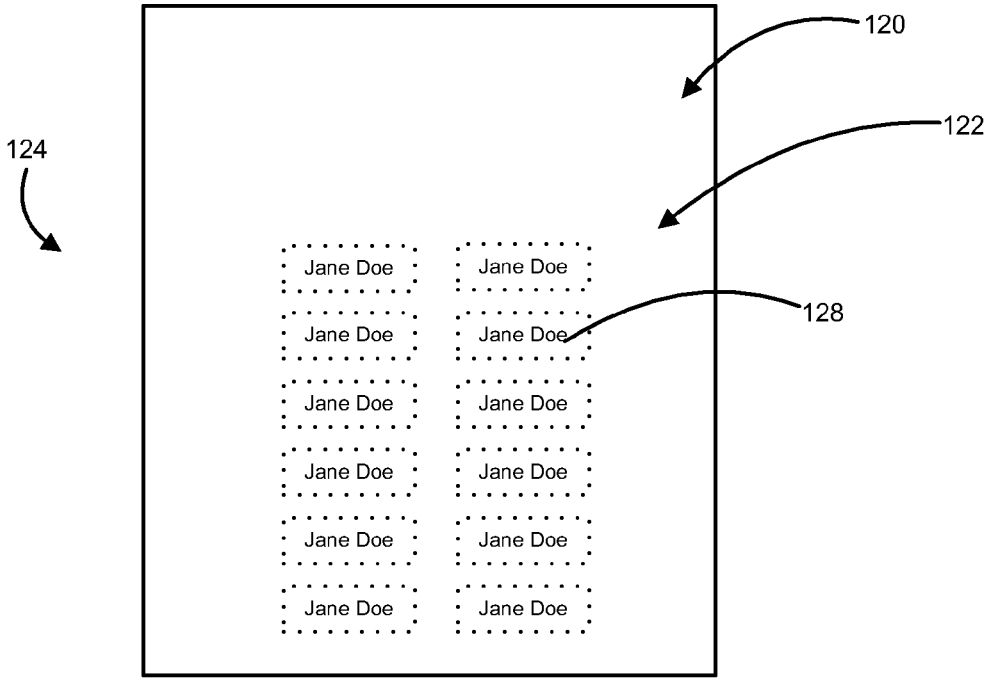
FIG. 8 is front plan view of an embodiment of a second panel of an achievement award assembly including a third indicia layer printed on a front side.

FIG. 8 is front plan view of a second panel 120 of the achievement award assembly 100 illustrated in FIG. 2 including a third indicia layer 122 printed on a front side. In one embodiment, the second panel 120 is configured as a sheet of paper. However, one of ordinary skill in the art will recognize that the second panel 120 may have any suitable configuration in order to provide the necessary functionality. This template document 124 may be created by any suitable process, such as, for example, printed using a software program that provides the necessary template for the required fields of information in the proper position so as to be aligned in registration with the defined areas. Then the user will insert the template document 124 through the door 116 and opening 114 in order to align the third indicia layer 122 with the defined areas 130 so that after securing the document to the first panel 102 or mount 112 as described above and closing the door 116, the final result of the above described process and method generates the result shown in FIG. 1, where the third indicia layer 122, including for example an award indicia 128, is visible from the front of the achievement award 100, yet can be readily changed by the user as necessary.

The above detailed description and the examples described therein have been presented for the purposes of illustration and description only and not by limitation. It is therefore contemplated that the present disclosure cover any and all modifications, variations or equivalents that fall within the spirit and scope of the basic underlying principles disclosed above and claimed herein.

What is claimed is:

1. An achievement award assembly comprising:

a first panel having a semi-transparent first layer imprinted on a back side of the first panel and an opaque second layer imprinted over the semi-transparent first layer, the first panel having a semi-transparent area defined by regions on the first panel where the opaque second layer is not imprinted over the semi-transparent first layer wherein the semi-transparent first layer provides an appearance of a solid material;

a second panel contiguous to the first panel and including at least one award indicia displayed thereon in a predetermined pattern such that the at least one award indicia is positioned within the semi-transparent area and visible through the semi-transparent first layer such that the at least one award indicia appears to be located on the solid material; and a mount connected to the first panel.

2. The achievement award assembly of claim 1 wherein the second panel is a template document with content deposited thereon.

3. The achievement award assembly of claim 1 wherein the mount includes a door, the boundaries of which define an opening such that when the door is in an open state the second panel can be removed through the opening.

4. The achievement award assembly of claim 1 wherein the at least one semi-transparent area has the appearance of an engraved metallic plate.

5. The achievement award assembly of claim 3 wherein the opening and the second panel are sized such that the at least one award indicia is located substantially central in the at least one semi-transparent area.

6. The achievement award assembly of claim 1 wherein the first panel is made of a clear acrylic material.

7. The achievement award assembly of claim 1 wherein the first layer comprises ink imprinted on the back side of the first panel.

8. The achievement award assembly of claim 1 wherein the second panel is a piece of paper with an indicia layer deposited thereon.

9. An achievement award assembly comprising:

a first panel having a semi-transparent first layer imprinted on a back side of the first panel and an opaque second layer imprinted over the semi-transparent first layer, the first panel having a semi-transparent area defined by regions on the first panel where the opaque second layer is not imprinted over the semi-transparent first layer wherein the semi-transparent first layer provides an appearance of a solid material; and a second panel contiguous to the first panel and including at least one award indicia displayed thereon in a predetermined pattern such that the at least one award indicia is positioned within the semi-transparent area and visible through the one semi-transparent first layer such that the at least one award indicia appears to be located on the solid material.

10. The achievement award assembly of claim 9 wherein the second panel is a template document with content deposited thereon.

11. The achievement award assembly of claim 9 wherein the at least one semi-transparent area has the appearance of an engraved metallic plate.

12. The achievement award assembly of claim 9 wherein the first panel is made of a clear acrylic material.

13. The achievement award assembly of claim 9 wherein the first layer comprises ink imprinted on the back side of the first panel.

14. The achievement award assembly of claim 9 wherein the second panel is a piece of paper with an indicia layer deposited thereon.

15. A method for assembling an achievement award comprising:

depositing a semi-transparent first layer onto a back surface of a first panel and an opaque second layer over the semi-transparent first layer such that the first panel has a semi-transparent area defined by regions on the first panel where the opaque second layer is not deposited over the semi-transparent first layer wherein the semi-transparent first layer provides the appearance of a solid material; and connecting a mount to the back surface of the first panel such that when a second panel is placed contiguous to the first panel, at least one award indicia on the second panel is positioned within the semi-transparent area and is visible through the semi-transparent first layer such that the award indicia appears to be located on the solid material.

16. The method of claim 15 wherein the semi-transparent first layer is configured such that the award indicia visible through the semi-transparent first layer has the appearance of an metallic plate engraved with the award indicia.

17. The method of claim 15 further comprising:

placing the second panel contiguous to the first panel through an opening defined by a door located on the mount.

* * * * *